US008430135B2

(12) United States Patent
Waters

(10) Patent No.: US 8,430,135 B2
(45) Date of Patent: Apr. 30, 2013

(54) DISPENSING APPARATUS AND WEIGHING PROCESS WITH CONTROL UNIT

(75) Inventor: Marshall Thomas Waters, North Melbourne (AU)

(73) Assignee: Autopour Pty Ltd, North Melbourne Victoria (AU)

( * ) Notice: Subject to any disclaimer, the term of this patent is extended or adjusted under 35 U.S.C. 154(b) by 865 days.

(21) Appl. No.: 12/442,587

(22) PCT Filed: Sep. 26, 2007

(86) PCT No.: PCT/AU2007/001428

§ 371 (c)(1),
(2), (4) Date: Aug. 17, 2009

(87) PCT Pub. No.: WO2008/037010

PCT Pub. Date: Apr. 3, 2008

(65) Prior Publication Data

US 2010/0037985 A1 Feb. 18, 2010

(30) Foreign Application Priority Data

Sep. 26, 2006 (AU) ..... 2006905325

(51) Int. Cl.
*B65B 1/30* (2006.01)

(52) U.S. Cl.
USPC ..... 141/83; 141/94; 141/95; 141/192; 141/198; 141/2

(58) Field of Classification Search ..... 141/2, 83, 141/94, 95, 192, 198
See application file for complete search history.

(56) References Cited

U.S. PATENT DOCUMENTS

| | | | | |
|---|---|---|---|---|
| 4,331,262 | A | 5/1982 | Snyder et al. | |
| 4,856,563 | A * | 8/1989 | Yamaguchi et al. | 141/1 |
| 5,148,841 | A * | 9/1992 | Graffin | 141/83 |
| 5,375,634 | A * | 12/1994 | Egger | 141/83 |
| 5,515,888 | A * | 5/1996 | Graffin | 141/1 |
| 5,738,247 | A | 4/1998 | Kuan et al. | |
| 5,855,232 | A * | 1/1999 | Oda et al. | 141/83 |
| 6,164,189 | A | 12/2000 | Anson | |
| 6,220,312 | B1 * | 4/2001 | Hirsch et al. | 141/83 |
| 6,321,798 | B1 * | 11/2001 | Solignac | 141/2 |
| 6,334,471 | B1 * | 1/2002 | Graffin | 141/83 |
| 6,655,421 | B2 * | 12/2003 | Kohashi et al. | 141/83 |
| 6,857,453 | B2 * | 2/2005 | Nishino et al. | 141/83 |
| 7,868,260 | B2 * | 1/2011 | MacMichael et al. | 177/108 |

FOREIGN PATENT DOCUMENTS

WO 9015755 A 12/1990

* cited by examiner

*Primary Examiner* — Timothy L Maust
(74) *Attorney, Agent, or Firm* — Volpe and Koenig, P.C.

(57) ABSTRACT

A dispensing apparatus is provided having a platform for receipt of a container such as a wine glass. The platform is connected to a transducer which is sensitive to weight on the platform and which produces an electrical signal dependant on the magnitude of that weight. Electrical outputs from the transducer are connected to a control unit over connections. The control unit includes a keypad and a display. Control signals from control unit are supplied over electrical connections to a solenoid valve. The control unit controls the flow of material by opening and closing solenoid valve.

18 Claims, 1 Drawing Sheet

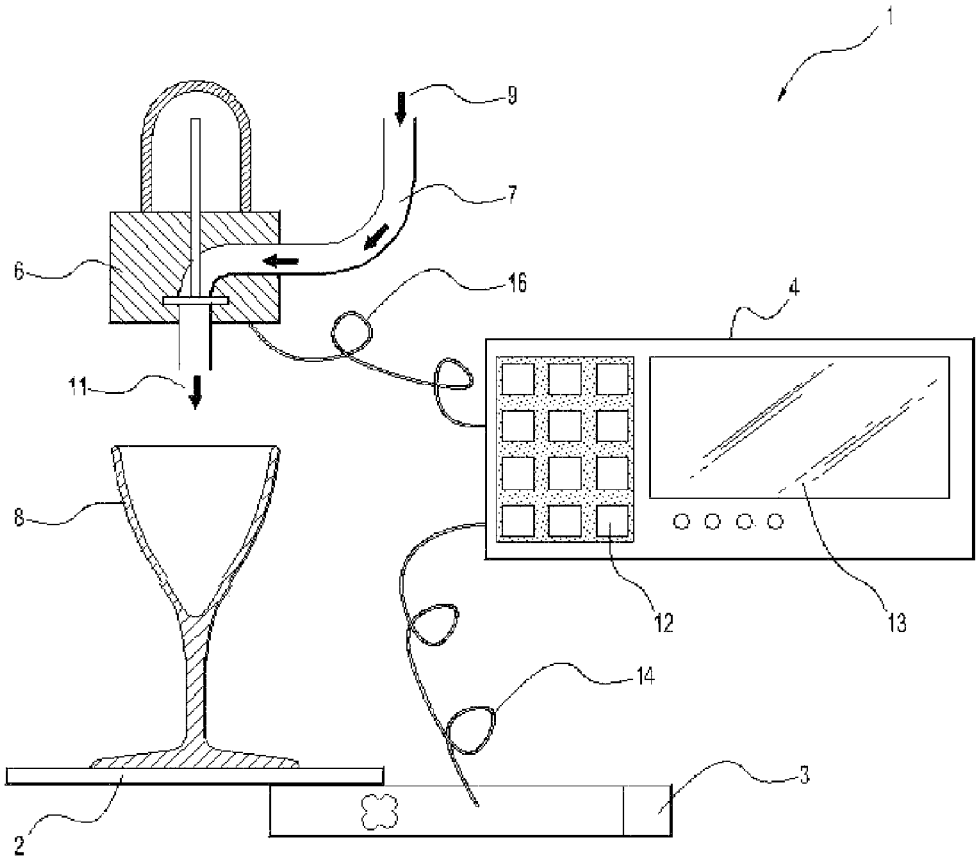
1
9
7
6
16
4
11
8
12
13
14
3
2

DISPENSING APPARATUS AND WEIGHING PROCESS WITH CONTROL UNIT

FIELD OF THE INVENTION

The present application relates to the measured dispensing of liquids (such as beverages) and of fluent solids (such as some granular materials).

BACKGROUND OF THE INVENTION

Other products in the field use food grade flow meters which can be expensive to purchase and fragile when cleaning. Others use timed pours, which rely on constant head pressure that can be a cause of failure to be accurate. Others use a pump that is capable of delivering an accurate measured amount but are expensive and bulky to use in a mass-produced bar-top piece of equipment.

SUMMARY OF THE INVENTION

According to one aspect, the present invention provides dispensing apparatus comprising:

means for dispensing material into a container;

means for monitoring the weight of the container and its contents (if any); and means for stopping the dispensing of material into the container when the combined weight of the container and its contents reach a predetermined value.

It is preferred that the means for dispensing fluid into a container comprises a solenoid valve.

It is preferred that the means for monitoring the weight of the container and its contents comprises a weight-sensitive element which produces an electrical output.

It is preferred that the means for monitoring the weight of the container and its contents is chosen from the group consisting of:

a strain gauge; and a load cell.

It is preferred that the dispensing apparatus further comprises a control unit which is adapted to:

receive a signal from the means for monitoring weight; and responsive to that signal, control the dispensing of material.

It is preferred that the control unit comprises:

input means by which an operator can input information about material that is to be dispensed.

It is preferred that the control unit is adapted to store data about the quantities of materials which have been dispensed.

It is preferred that the dispensing apparatus further comprises:

a plurality of means for dispensing material into a container; and a plurality of means for stopping the dispensing of material into the container when the combined weight of the container and its contents reach a predetermined value.

It is preferred that the control unit is adapted to store at least one of:

data about the tare (empty weight) of categories of containers into which material may be dispensed;

data about the weights of material that are to be dispensed into different categories of containers; and calibration data.

It is preferred that the calibration data comprises data about the weight of material that will be in transit to a container when the dispensing of material into the container is stopped.

It is preferred that the dispensing of material into the container is stopped whenever the rate of increase of the combined weight of the container and its contents exceeds a predetermined value.

According to another aspect, the present invention provides process of dispensing material into a container, comprising:

commencing the dispensing of material into the container;

continually monitoring the weight of the container and its contents; and stopping the dispensing of material into the container when the combined weight of the container and its contents reach a predetermined value.

It is preferred that a solenoid valve is used to control the commencing and stopping of the dispensing of material into the container.

It is preferred that the weight of the container and its contents is monitored by a weight-sensitive element which produces an electrical output.

It is preferred that the means for monitoring the weight of the container and its contents is chosen from the group consisting of:

a strain gauge; and a load cell.

It is preferred that a control unit is used to:

receive a signal from the means for monitoring weight; and responsive to that signal, control the dispensing of material.

It is preferred that the control unit comprises input means by which an operator can input information about material that is to be dispensed.

It is preferred that the control unit is adapted to store data about the quantities of materials which have been dispensed.

It is preferred that the control unit is adapted to store at least one of:

data about the tare (empty weight) of categories of containers into which material may be dispensed;

data about the weights of material that are to be dispensed into different categories of containers; and calibration data.

It is preferred that the calibration data comprises data about the weight of material that will be in transit to a container when the dispensing of material into the container is stopped.

It will be seen that the invention enables a measured pour of beverage using weight to determine the dispensed amount. It allows for different size pours to be automatically poured into different sized vessels all hands free.

The invention allows the user to simply place the container on the machine after which the machine will dispense a predetermined volume of beverage to suit the container placed on the machine and to record the pour for later accounting.

BRIEF DESCRIPTION OF THE DRAWINGS

FIG. 1 is a front elevational view, partly in section, of apparatus according to preferred embodiments of the present invention.

DESCRIPTION OF PREFERRED EMBODIMENTS OF THE INVENTION

Dispensing apparatus 1 according to the embodiment of FIG. 1 has a platform 2 for receipt of a container such as a wine glass 8. The platform 2 is connected to a transducer 3 which is sensitive to weight on the platform 2 and which produces an electrical signal dependant on the magnitude of that weight. Suitable forms of the transducer 3 include strain gauges and load cells.

Electrical outputs from the transducer 3 are connected to a control unit 4 over connections 14. The control unit 4 includes a keypad 12 and a display 13. Control signals from control unit 4 are supplied over electrical connections 14 to a solenoid valve 6.

Flow of materials to be dispensed are illustrated as input 9 of the input conduit 7 to the solenoid valve 8 and flow of material out of the solenoid valve 6 are illustrated by the arrow 11. The input flow 9 can be supplied by any suitable means such as by gravity flow from a hopper or the like or by flow of liquid from a gas-pressurized container or the like, neither of which is illustrated in the drawing.

The control unit 4 is microprocessor based. Responsive to operator-entered instructions on keypad 12 and weight-related signals received from the transducer 3, the control unit controls the flow of material by opening and closing solenoid valve 6. The control program within the control unit 4 also maintains comprehensive records of the quantities of materials that have been dispensed. The records also include "failed events", such as a "short fill".

Although the embodiment of FIG. 1 shows only one solenoid valve and only one transducer, according to alternative embodiments of the invention, that are not illustrated in the drawings, there may be multiple transducers and multiple solenoid valves controlled by one control unit.

A calibration process takes place before the dispensing apparatus 1 is placed into service. In this calibration process, data is input to the control unit about the tare (empty weight) of the different types of containers into which material is to be dispensed. For each of these tare weights, a different target fill weight is entered. It will be appreciated that when the solenoid valve 6 closes during dispensing of material, there will be material "in-flight" which has already exited the solenoid valve but which has not yet landed in the container 8. The calibration process measures the in-flight masses of the various materials to be dispensed and enters these masses as data into the control unit 4.

When the dispensing apparatus 1 is in use, a container is placed on the platform 2 and the operator uses the keypad 12 to enter into the control unit 4 instructions which identify the material that is to be dispensed and the quantity of material that is to be dispensed. According to alternative preferred embodiments of the invention, data that has been entered into the control unit 4 during calibration or otherwise pre-identifies the quantity of material that is to be dispensed according to the measured tare weight.

The control unit 4 measures the weight of the container 8 plus its contents, and when that combined weight, minus the pre-calibrated in-flight weight, reaches a target weight the control unit 4 closes the solenoid valve 6.

At the end of any trading period the user can take a read-out of accumulated data from the control unit 4 using the display 13 or by using any other suitable output device.

Any interference with the predicted continuously rising weight on the transducer 3 results in the closure of the solenoid valve 6. This protects against spillage of the dispensed material resulting from displacement of the container 8 and against dispensing material where that dispensing has been triggered by the placing of a foreign object on the platform 2 (unless, by coincidence, that foreign object happens to have the same weight as the pre-set tare weight of a container 8). In addition, the solenoid valve 6 does not open until the tare weight of a container has stabilized. For example, the valve 6 will not open in response to the wiping of the platform 2 with a cloth for cleaning.

The solenoid valve 6 is also closed if the supply of material 9 fails during a dispensing operation. This means that, when the beverage supply is reinstated, the flow will not restart until the container 8 is removed from the platform 2 and replaced.

It is preferred that the control unit 4 also maintains cumulative data on all types of material dispensed, giving data that can be used for commercial or regulatory purposes.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

"Comprises/comprising" when used in this specification is taken to specify the presence of stated features, integers, steps or components but does not preclude the presence or addition of one or more other features, integers, steps, components or groups thereof.

The claims defining the invention are as follows:

1. A dispensing apparatus comprising:
- a dispenser that dispenses material into a container;
- a monitor that monitors the container's weight;
- a device that stops the dispensing of material into the container; and
- a control unit which is adapted to:
  - receive a signal from the weight monitor;
  - determine, based on container's tare weight, an amount of material to be dispensed;
  - control the dispensing of material, responsive to that signal;
  - store data about:
    - a tare weight of categories of containers into which material may be dispensed;
    - a target weight of material that is to be dispensed into a container based on the container's measured tare weight; and
    - calibration data which, for a given material, includes data about a weight of material that will be in transit to a container when the dispensing of material into the container is stopped; and
  - stop the dispensing of material into the container when the weight of material in the container plus the weight of material in transit to the container equals the target weight of material that is to be dispensed into the container based on the container's measured tare weight.

2. The dispensing apparatus as claimed in claim 1, wherein the dispenser is a fluid dispenser and comprises a solenoid valve.

3. The dispensing apparatus as claimed in claim 1, wherein the monitor comprises a weight-sensitive element which produces an electrical output.

4. The dispensing apparatus as claimed in claim 3, wherein the monitor is a strain gauge; or a load cell.

5. The dispensing apparatus as claimed in claim 1, wherein the control unit comprises an input by which an operator can input information about material that is to be dispensed.

6. The dispensing apparatus as claimed in claim 1, wherein the control unit is adapted to store data about quantities of materials which have been dispensed.

7. The dispensing apparatus as claimed in claim 1 further comprising:
- a plurality of dispensers; and a plurality of devices that stop the dispensing of material into the container when the weight of material in the container plus the weight of material in transit to the container equals the target weight of material that is to be dispensed into the container.

8. The dispensing apparatus as claimed in claim 1, wherein the dispensing of material into the container is stopped whenever the rate of increase of the combined weight of the container and its contents exceeds a predetermined value.

9. The dispensing apparatus as claimed in claim 1, wherein the dispensing of material into a container will not commence until the weight of an empty container as monitored has stabilized.

10. A process of dispensing a target weight of material into a container, the target weight depending on a tare weight of the container, the process comprising:

measuring the tare weight of the container;

determining a target weight of material to be dispensed based on the tare weight of the container;

commencing the dispensing of material into the container; and stopping the dispensing of material into the container when a combined weight of the container and its contents reach a predetermined value which is equal to the sum of:

the monitored weight of the empty container; and the target weight of material that is to be dispensed, which is determined based on the weight of the empty container, less the weight of material in transit to the container.

11. A process of dispensing material as claimed in claim 10, wherein a solenoid valve is used to control the commencing and stopping of the dispensing of material into the container.

12. A process of dispensing material as claimed in claim 10, wherein the weight of the container and its contents is monitored by a weight-sensitive element which produces an electrical output.

13. A process of dispensing material as claimed in claim 12, wherein the weight of the container and its contents is monitored by a strain gauge or a load cell.

14. A process of dispensing material as claimed in claim 13, wherein a control unit is used to:

receive a signal from the strain gauge or load cell; and control the dispensing of material, responsive to that signal.

15. A process of dispensing material as claimed in claim 14, wherein the control unit comprises an input by which an operator can input information about material that is to be dispensed.

16. A process of dispensing material as claimed in claim 14, wherein the control unit is adapted to store data about quantities of materials which have been dispensed.

17. A process of dispensing material into a container as claimed in claim 14, wherein the control unit is adapted to store data about:

tare weights of categories of containers into which material may be dispensed; and target weights of material that is to be dispensed into a container according to its measured tare weight.

18. A process of dispensing material into a container as claimed in claim 17, wherein for a given material, calibration data comprises data about the weight of material that will be in transit to a container when the dispensing of material into the container is stopped.

* * * * *